US008501377B2

(12) United States Patent
Takahashi et al.

(10) Patent No.: US 8,501,377 B2
(45) Date of Patent: Aug. 6, 2013

(54) MAGNETIC TONER

(75) Inventors: Toru Takahashi, Mishima (JP); Katsuhisa Yamazaki, Numazu (JP); Shuhei Moribe, Mishima (JP); Daisuke Tsujimoto, Suntou-gun (JP); Masami Fujimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 13/354,092

(22) Filed: Jan. 19, 2012

(65) Prior Publication Data

US 2012/0196220 A1 Aug. 2, 2012

(30) Foreign Application Priority Data

Jan. 27, 2011 (JP) ..... 2011-015277

(51) Int. Cl.
*G03G 9/08* (2006.01)

(52) U.S. Cl.
USPC ..... 430/106.1; 430/106.2; 430/109.4; 430/111.41

(58) Field of Classification Search
USPC ..... 430/106.1, 106.2, 109.4, 111.41
See application file for complete search history.

(56) References Cited

U.S. PATENT DOCUMENTS

| | | | |
|---|---|---|---|
| 5,354,637 | A | 10/1994 | Shimamura et al. |
| 5,406,357 | A | 4/1995 | Nakahara et al. |
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,547,796 | A | 8/1996 | Kohtaki et al. |
| 5,716,746 | A | 2/1998 | Mikuriya et al. |
| 5,968,701 | A | 10/1999 | Onuma et al. |
| 6,020,102 | A | 2/2000 | Fujimoto et al. |
| 6,077,638 | A | 6/2000 | Tanikawa et al. |
| 6,120,961 | A | 9/2000 | Tanikawa et al. |
| 6,156,471 | A | 12/2000 | Kobori et al. |
| 6,187,496 | B1 | 2/2001 | Tanikawa et al. |
| 6,203,959 | B1 | 3/2001 | Tanikawa et al. |
| 6,235,441 | B1 | 5/2001 | Tanikawa et al. |
| 6,426,169 | B1 | 7/2002 | Onuma et al. |
| 6,458,499 | B1 | 10/2002 | Onuma et al. |
| 6,541,174 | B1 | 4/2003 | Tanikawa et al. |
| 6,586,151 | B1 | 7/2003 | Naka et al. |
| 6,589,701 | B2 | 7/2003 | Yamazaki et al. |
| 6,653,036 | B1 | 11/2003 | Tanikawa et al. |
| 6,670,087 | B2 | 12/2003 | Fujikawa et al. |
| 6,703,176 | B2 | 3/2004 | Naka et al. |
| 6,875,549 | B2 | 4/2005 | Yamazaki et al. |
| 6,881,527 | B2 | 4/2005 | Moribe et al. |
| 7,001,703 | B2 | 2/2006 | Moribe et al. |
| 7,097,951 | B2 | 8/2006 | Moribe et al. |
| 7,147,981 | B2 | 12/2006 | Fujikawa et al. |
| 7,150,953 | B2 | 12/2006 | Yamazaki et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,537,877 | B2 | 5/2009 | Yoshiba et al. |
| 7,544,455 | B2 | 6/2009 | Yoshiba et al. |
| 7,638,251 | B2 | 12/2009 | Yamazaki et al. |
| 7,700,254 | B2 | 4/2010 | Moribe et al. |
| 7,740,998 | B2 | 6/2010 | Yamazaki et al. |
| 7,855,042 | B2 | 12/2010 | Kobori et al. |
| 7,897,316 | B2 | 3/2011 | Yamazaki et al. |
| 8,026,030 | B2 | 9/2011 | Moribe et al. |
| 8,057,977 | B2 | 11/2011 | Moribe et al. |
| 2011/0256480 | A1 | 10/2011 | Yamazaki et al. |

FOREIGN PATENT DOCUMENTS

| | | | |
|---|---|---|---|
| JP | 2006-30881 | A | 2/2006 |
| JP | 4136899 | B2 | 8/2008 |
| JP | 4307297 | B2 | 8/2009 |

OTHER PUBLICATIONS

Moribe, et al., U.S. Appl. No. 13/354,078, filed Jan. 19, 2012.

*Primary Examiner* — Mark A Chapman
(74) *Attorney, Agent, or Firm* — Fitzpatrick, Cella, Harper & Scinto

(57) ABSTRACT

Provided is a magnetic toner capable of providing a stable image by suppressing sleeve contamination even under a high-temperature and high-humidity environment and under a normal-temperature and low-humidity environment and further suppressing large-particle fogging caused after the toner is left alone for a week. The magnetic toner contains toner particles, each of which contains a binder resin and a magnetic iron oxide particle, in which the binder resin has a polyester unit, the toner has i) a dielectric loss factor at 40° C. and 100 kHz of 0.50 pF/m or more but 0.90 pF/m or less, and ii) a true specific gravity of 1.50 g/cm$^3$ or more but 1.85 g/cm$^3$ or less.

3 Claims, No Drawings

MAGNETIC TONER

BACKGROUND OF THE INVENTION

1. Field of the Invention

The present invention relates to a magnetic toner for use in an image forming method for visualizing an electrostatic latent image in electrophotography.

2. Description of the Related Art

On-demand printing has recently been increasingly required for an image forming apparatus such as a copier and a printer. A highly reliable toner realizing higher-speed printing and higher-quality images has thus been desired. Additionally, since environment of the use has diversified, a toner that can provide stable images, even used under various environments, has been desired.

Of the image-forming systems, a single-component development system is favorably used because the development system is a developing apparatus simply constructed and having fewer problems and has a long product-life and ease of maintenance.

Several techniques are known for the single-component development system. One of the techniques is jumping development using a magnetic toner. In the jumping development, a magnetic toner is frictionally charged, allowed to jump on a photoreceptor by application of an alternate-current developing bias to develop an electrostatic latent image formed on the photoreceptor into a visible toner image.

To obtain a high-quality image by the jumping development, electrification characteristics of a magnetic toner are critical. However, in general, the electrification characteristics of a magnetic toner greatly vary depending upon the operating environment. For example, under a normal-temperature and low-humidity environment, the electrification amount of a magnetic toner is likely to increase. The magnetic toner having a high electrification amount easily attaches onto a sleeve by image force, causing so-called sleeve contamination. The magnetic toner attached onto the sleeve interrupts frictional electrification between another magnetic toner and the sleeve. As a result, the density of toner decreases and a high-quality image may not be obtained.

Furthermore, under a high-temperature and high-humidity environment, the electrification amount of a magnetic toner is likely to decrease. In addition, a developing apparatus is often left alone for about a week without being operated, taking a long vacation of an office, etc., into consideration. If a developing apparatus is left alone for a week, electrification of a magnetic toner is relaxed and electrostatic repulsion decreases. Agglomeration of toner particles easily occurs. As a result, the toner agglomerate flies to a non-image forming area. This is called large-particle fogging, which often has a harmful effect upon an image.

Furthermore, large-particle fogging is likely to occur, if electrification is relaxed after leaving a toner alone, even under a normal-temperature and low-humidity environment, whereas the density of toner decreases in some cases, even if a sleeve is slightly contaminated, under a high-temperature and high-humidity environment.

To deal with such problems, various studies have been conducted in order to control electrification characteristics of a magnetic toner. Particularly, in a magnetic toner used in a process for developing an image following application of an alternate-current developing bias like a jumping development, values of a dielectric constant, a dielectric loss factor and dielectric loss tangent are important. Several techniques for obtaining a stable image by controlling these characteristic values have been proposed.

For example, Japanese Patent Application Laid-Open No. 2006-030881 discloses a magnetic toner having excellent developability, even under a high-temperature and high-humidity environment, which is obtained by controlling a dielectric loss tangent and an average circularity to fall within a desired range. However, in view of the dielectric loss tangent value proposed in this patent document, an electrification amount is likely to increase and sleeve contamination may occur under a normal-temperature and low-humidity environment.

Furthermore, Japanese Patent No. 4136899 discloses a magnetic toner having excellent dot reproducibility and less fogging, which is obtained by defining the dielectric constants of the magnetic toner and an external additive together with the particle diameter, true specific gravity, etc., of a magnetic toner. However, the magnetic toner proposed in this patent document exhibits satisfactory developability in a normal operation time but if the magnetic toner is left under a high-temperature and high-humidity environment for a week, large-particle fogging often generates. Further improvement is required.

Furthermore, Japanese Patent No. 4307297 discloses a magnetic toner using a resin having a glycidyl group and providing a stable image even in a two-sided output operation by defining a dielectric constant and a dielectric loss tangent. However, also in the magnetic toner proposed in this patent document, if the magnetic toner is left alone under a high-temperature and high-humidity environment for a week, large-particle fogging may occur.

As described above, there are a great many technical problems for obtaining a stable image under environments different in electrification characteristics of a magnetic toner, such as under a normal-temperature and low-humidity environment and under a high-temperature and high-humidity environment. In addition, if a toner is left alone for a week, although it is not a rare case in daily operation, since electrification relaxation of a magnetic toner proceeds, conditions of the magnetic toner become particularly severe. To obtain a stable image under these environments, a further improvement is required.

An object of the present invention is to provide a magnetic toner with which the aforementioned problems have been overcome. More specifically, an object of the present invention is to provide a magnetic toner providing a stable image while suppressing sleeve contamination and large-particle fogging even under environments different in electrification characteristics of a magnetic toner.

SUMMARY OF THE INVENTION

The present invention is directed to a magnetic toner comprising toner particles, each of which contains a binder resin and a magnetic iron oxide particle, in which the binder resin has a polyester unit, the toner has i) a dielectric loss factor at 40° C. and 100 kHz of 0.50 pF/m or more but 0.90 pF/m or less, and ii) a true specific gravity of 1.50 g/cm$^3$ or more but 1.85 g/cm$^3$ or less.

According to the present invention, sleeve contamination can be suppressed even under a high-temperature and high-humidity environment and under a normal-temperature and low-humidity environment by controlling the dielectric loss factor and true specific gravity of a magnetic toner within predetermined ranges. Furthermore, a magnetic toner providing a stable image while suppressing large-particle fogging after the magnetic toner is left alone for a week can be provided.

Further features of the present invention will become apparent from the following description of exemplary embodiments.

DESCRIPTION OF THE EMBODIMENTS

Preferred embodiments of the present invention will now be described in detail.

Now, the present invention will be described in detail.

The present inventors have conducted various studies in order to obtain a stable image by suppressing large-particle fogging and sleeve contamination under various environments. To obtain a stable image, it is necessary to control behavior of a magnetic toner under application of a developing bias. As one of the control techniques, in the prior art, a method of controlling the electrification amount of magnetic toner has been conceived. However, if electrification performance of a magnetic toner changes, the electrification amount may significantly vary depending upon the operating environment. If the electrification amount varies, a large effect is exerted on developability, etc. Thus, it has been difficult to obtain a stable image.

Then, the present inventors conducted studies, with a view to solving the aforementioned problem, on factors of controlling a behavior of a magnetic toner under application of a developing bias other than the electrification amount. As a result, the present inventors found that sleeve contamination and large-particle fogging can be suppressed under various environments by controlling not the electrification amount of magnetic toner but polarization performance.

More specifically, the magnetic toner of the present invention comprises toner particles, each of which contains a binder resin and a magnetic iron oxide particle, in which the binder resin has a polyester unit, the toner has i) a dielectric loss factor at 40° C. and 100 kHz of 0.50 pF/m or more but 0.90 pF/m or less, and ii) a true specific gravity of 1.50 g/cm$^3$ or more but 1.85 g/cm$^3$ or less.

In short, the present invention is characterized in that the dielectric loss factor and true specific gravity of a magnetic toner containing a binder resin having a polyester unit are controlled to fall within the aforementioned ranges. The dielectric loss factor can be considered as an indicator of polarization performance of a magnetic toner as later described. The present inventors found that the behavior of a magnetic toner under application of a developing bias can be controlled by controlling not only the polarization performance of a magnetic toner but also the true specific gravity, and thereby sleeve contamination and large-particle fogging are improved.

The dielectric loss factor is a value generally representing sensitivity of polarization response to an electric field. A high dielectric loss factor means that the sensitivity of polarization response to an electric field is low and resistance of polarization response is lost as heat energy.

The dielectric loss factor of a magnetic toner varies depending upon not only the physical properties of a binder resin and a magnetic iron oxide particle but also the dispersibility of a magnetic iron oxide particle in a magnetic toner. With respect to the dispersibility of a magnetic iron oxide particle, as a diameter of a dispersion state of the magnetic iron oxide particles (In a case of aggregational state, a diameter of aggregate is measured) increases, a dielectric loss factor tends to increase. Since the magnetic iron oxide particle is a conductive material, the magnetic iron oxide particle is considered to be a leak site of electrification. The dielectric loss factor representing dispersibility of the magnetic iron oxide particle has been used as an indicator of electrification retention capacity.

The frequency in measuring the dielectric loss factor of the present invention is set at 100 kHz. This is because 100 kHz is a frequency required for causing polarization at a particle level in measuring dielectric loss factors of a resin and a magnetic iron oxide particle. The temperature in measuring the dielectric loss factor of the present invention is set at 40° C. This is because the temperature in the proximity of a sleeve when sheets are continuously fed to a developing apparatus is assumed to be 40° C.

In the present invention, the value of the dielectric loss factor is controlled to be higher than a conventional value. As a result, it is considered that sensitivity of polarization response to an electric field becomes low. The phase "sensitivity of polarization response becomes low" means that it is difficult to cause polarization in response to the force applied by the electric field.

In the meantime, cohesive force, which is generated when electrification of a magnetic toner is relaxed by leaving the toner alone for a week, is conceivably constituted dominantly of electrostatic attractive force induced by polarization of a magnetic toner. More specifically, if the value of the dielectric loss factor is controlled to be higher than a conventional value, even when a magnetic toner relaxed in electrification is placed in the electric field, occurrence of electrostatic agglomerate is conceivably suppressed.

Furthermore, the dielectric loss factor is also related to electrification retention capacity of a magnetic toner. If a dielectric loss factor is high, excessive electrification is conceivably prevented. As a result, image force is conceivably suppressed from generating on a sleeve and sleeve contamination is reduced.

In the present invention, the dielectric loss factor is 0.50 pF/m or more but 0.90 pF/m or less and favorably 0.60 pF/m or more but 0.80 pF/m or less. If the dielectric loss factor is more than 0.90 pF/m, polarization response becomes excessively slow. In addition, a toner sometimes fails to have a desired electrification amount. As a result, the toner fails to follow a developing bias and the density of the toner may decrease. In contrast, if the dielectric loss factor is less than 0.50 pF/m, polarization response increases. As a result, large-particle fogging is likely to occur.

In the present invention, the dielectric loss factor is measured by the following method.

After a 4284A precision LCR meter (manufactured by Hewlett-Packard Development Company, L.P.) is corrected at a frequency of 1 kHz and 1 MHz, a complex dielectric constant was measured at a frequency of 3 kHz and 100 kHz. From the complex dielectric constant values measured, a dielectric loss factor was computationally obtained.

A magnetic toner (1.0 g) is weighed and molded into a disk-form measurement sample having a diameter of 25 mm and a thickness of 1 mm or less (favorably 0.5 to 0.9 mm) by applying a load of 19600 kPa (200 kg/cm$^2$) over 2 minutes. The measurement sample is loaded on ARES (manufactured by Rheometric Scientific F. E.) equipped with a dielectric constant measurement tool (electrode) having a diameter of 25 mm and heated up to a temperature of 70° C. to melt and fix thereto. Thereafter, the measurement sample is cooled to a temperature of 40° C. and measured at frequencies of 3 kHz and 100 kHz, while applying a load of 0.49 to 1.96 N (50 to 200 g). In this manner, a dielectric constant value is obtained.

The effect of the present invention cannot be sufficiently obtained even if a dielectric loss factor alone is controlled to fall within the above range. It is necessary to control a true specific gravity together with a dielectric loss factor in obtaining the effect of the present invention.

The true specific gravity of a magnetic toner varies depending upon not only properties of a binder resin and a magnetic iron oxide particle but also a mixing ratio of the binder resin and the magnetic iron oxide particle. The true specific gravity can be used as an indicator of weight of a magnetic toner. If a magnetic toner is heavy, even if force is applied to the magnetic toner from an electric field, sensitivity of the magnetic toner is low. Conversely, if a magnetic toner is light, the sensitivity of the magnetic toner is high and responds even to small force.

The true specific gravity of a magnetic toner is 1.50 g/cm$^3$ or more but 1.85 g/cm$^3$ or less and favorably 1.60 g/cm$^3$ or more but 1.80 g/cm$^3$ or less. If the true specific gravity of a magnetic toner is more than 1.85 g/cm$^3$, the magnetic toner is excessively heavy and the response of the toner to force applied from an electric field becomes slow. As a result, the magnetic toner is easily accumulated on a sleeve and the density of the magnetic toner reduces. In contrast, if the true specific gravity of a magnetic toner is less than 1.50 g/cm$^3$, since the magnetic toner is light, the magnetic toner responds even to electrostatic attractive force between magnetic toners and is thus likely to generate agglomerate. As a result, large-particle fogging often occurs.

In the present invention, true specific gravity is measured by the following method.

A helium gas substitution system Accupyc 1330 (manufactured by Shimadzu Corporation) is used. In the measurement method, a measurement sample (4 g) is placed in a cell formed of stainless steel having an inner diameter of 18.5 mm, a length of 39.5 mm and a volume of 10 cm$^3$. Subsequently, the volume of the magnetic toner in a sample cell is measured based on pressure change of helium. The density of the magnetic toner is obtained based on the volume thus obtained and the weight of the sample.

To control the dielectric loss factor and the true specific gravity, it is essential that a binder resin contains a polyester unit. This is because the dielectric loss factor of a polyester resin is relatively high. This is further because a polyester resin has high affinity with a magnetic iron oxide particle and is excellent in dispersing a magnetic iron oxide particle in a melt/kneading process. For the reasons mentioned, containing a polyester unit is favorable to control the dielectric loss factor and the true specific gravity.

In summary, the most distinctive characteristic of the present invention on which the present inventors focused resides in controlling not the electrification amount of magnetic toner but controlling values of polarization performance and true specific gravity in order to control a behavior of a magnetic toner under application of a developing bias. As a result, the present inventors found that a stable image can be obtained while suppressing large-particle fogging and sleeve contamination under various environments.

Furthermore, according to the magnetic toner of the present invention, a dielectric loss factor at 40° C. and 3 kHz is more favorably 0.20 pF/m or more but 0.50 pF/m or less. If the dielectric loss factor is controlled to fall within the range, sleeve contamination and large-particle fogging can be efficiently suppressed.

A measurement condition of 3 kHz is a value close to a frequency of a developing bias. The dielectric loss factor can be considered as an indicator of polarization response to a developing bias. If a dielectric loss factor is higher than 0.50 pF/m, polarization response to a developing bias is excessively low. In this case, a sleeve may be more significantly contaminated. If a dielectric loss factor is lower than 0.20 pF/m, the polarization response is excessively high. In this case, significant large-particle fogging occurs.

Furthermore, the magnetic toner of the present invention favorably has a saturation magnetization of 10 Am$^2$/kg or more but 30 Am$^2$/kg or less when a magnetic-field of 79.58 kA/m (1 k oersted) is applied, and more favorably 14 Am$^2$/kg or more but 28 Am$^2$/kg or less. The value of 1 k oersted is a value of magnetic force assumed to be applied onto a sleeve. The saturation magnetization in the magnetic field is considered as an indicator of force at which a magnetic toner is magnetically captured on the sleeve. If the saturation magnetization of a magnetic toner is controlled to fall within the aforementioned range, sleeve contamination and large-particle fogging can be more efficiently suppressed to obtain a stable image density. The saturation magnetization of a magnetic toner can be controlled by the saturation magnetization of a magnetic iron oxide particle used and the content of the magnetic iron oxide particle in the magnetic toner.

In the present invention, the magnetic property of a magnetic toner can be measured by a vibrating magnetometer, for example, VSM P-1-10 (manufactured by TOEI INDUSTRY CO., LTD.) under conditions: a temperature of 25° C. and an external magnetic field of 79.6 kA/m.

Furthermore, the alcohol component of the polyester unit more favorably contains an aliphatic alcohol in an amount of 80 mol % or more for the reason: since the balance between the dielectric loss factor and the true specific gravity of the present invention can be more easily controlled, large-particle fogging and sleeve contamination can be more efficiently suppressed. Note that, "the alcohol component of a polyester unit" refers to a moiety derived from an alcohol of the components constituting the polyester unit.

Furthermore, as a binder resin to be used in the present invention, a polyester resin having crystallinity by partly orienting the molecules is favorable. Of these polyester resins, in particular, a linear polyester is favorable. Since a polyester resin has crystallinity by partly orienting the molecules, the molecules around the oriented molecule are hardly moved due to the intensive interaction called orientation. With this mechanism, the magnetic toner can be designed to have less-sensitive polarization response.

In the present invention, the components of a linear polyester resin particularly favorably used are as follows.

Examples of a divalent acid component include the following dicarboxylic acids and derivative thereof: benzene dicarboxylic acids such as phthalic acid, terephthalic acid, isophthalic acid and phthalic anhydride, and anhydrides and lower alkyl esters thereof; alkyl dicarboxylic acids such as succinic acid, adipic acid, sebacic acid and azelaic acid, and an anhydrides and lower alkyl esters thereof; alkenyl succinic acids and alkyl succinic acids such as n-dodecenyl succinic acid and n-dodecyl succinic acid, and anhydrides and lower alkyl esters thereof; and unsaturated dicarboxylic acids such as fumaric acid, maleic acid, citraconic acid and itaconic acid, and anhydrides and lower alkyl ester thereof.

In the present invention, it is favorable that a part of a molecular chain of a binder resin is oriented, as mentioned above. Thus, an aromatic dicarboxylic acid is favorably used since it has a rigid planar structure and molecules easily oriented by π-π interaction due to the presence of many electrons delocalized due to the π electron system.

Particularly favorably, terephthalic acid and isophthalic acid are used, which each easily form a linear structure. The content of such an aromatic dicarboxylic acid is favorably 50 mol % or more based on 100 mol % of the acid component constituting a polyester resin since the molecules are easily oriented.

Examples of a divalent alcohol component include the followings: ethylene glycol, polyethylene glycol, 1,2-propane diol, 1,3-propane diol, propylene glycol, 1,3-butane diol, 1,4-butane diol, 2,3-butane diol, diethylene glycol, triethylene glycol, 1,5-pentane diol, 1,6-hexane diol, neopentyl glycol, 2-methyl-1,3-propane diol, 2-ethyl-1,3-hexane diol, 1,4-cyclohexane dimethanol (CHDM), hydrogenated bisphenol A, a bisphenol represented by Formula (1) and a derivative thereof:

(1)

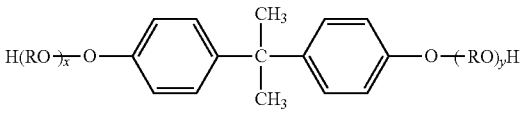

where R is an ethylene group or a propylene group; x and y each represent an integer of 0 or more; and, an average value of x+y is 0 to 10), and a diol represented by Formula (2).

(2)

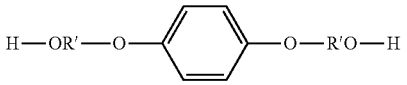

wherein R' represents —$CH_2CH_2$—, —$CH_2$—$CH(CH_3)$—, or —$CH_2$—$C(CH_3)_2$—.

Of them, an aliphatic alcohol having 6 or less carbon atoms is favorably used in consideration that molecules are partly oriented.

However, if an aliphatic alcohol is used alone, the degree of orientation is excessively high. Accordingly, the degree of the orientation of a polyester resin formed of an acid as mentioned above in combination with an alcohol as mentioned above must be lowered. To lower the degree of the orientation, a compound having a linear structure and a substituent at a side chain, by which the degree of orientation can be reduced, such as neopentyl glycol, 2-methyl-1,3-propane diol and 2-ethyl-1,3-hexane diol, is particularly favorably used.

As a resin having a linear structure and having a part highly oriented by an intermolecular interaction, a resin characterized by having an endothermic peak in a DSC curve, which is obtained by differential scanning calorimetry, is favorable. The binder resin of the present invention favorably has an endothermic peak P at a temperature of 55° C. or more but 75° C. or less.

The endothermic peak P is a peak derived from enthalpy relaxation and particularly easily emerges in a resin having a linear structure.

The polyester unit used in the present invention may contain, other than a divalent carboxylic acid compound and divalent alcohol compound as mentioned above, a monovalent carboxylic acid compound, a monovalent alcohol compound, a trivalent or more carboxylic acid compound, a trivalent or more alcohol compound, as a structural component.

Examples of the monovalent carboxylic acid compound include aromatic carboxylic acids having 30 or less carbon atoms such as benzoic acid and p-methyl benzoic acid; and n aliphatic carboxylic acids having 30 or less carbon atoms such as stearic acid and behenic acid.

Furthermore, examples of the monovalent alcohol compound include aromatic alcohols having 30 or less carbon atoms such as benzyl alcohol; and aliphatic alcohols having or less carbon atoms such as lauryl alcohol, cetyl alcohol, stearyl alcohol and behenyl alcohol.

Examples of the trivalent or more carboxylic acid compound include, but not particularly limited to, trimellitic acid, trimellitic anhydride and pyromellitic acid.

Furthermore, examples of the trivalent or more alcohol compound include trimethylolpropane, pentaerythritol and glycerin.

The method for producing a polyester resin of the present invention is not particularly limited and a known method can be used. For example, a polyester resin is produced by supplying a carboxylic acid compound and an alcohol compound as mentioned above together, and polymerizing the carboxylic acid compound and the alcohol compound through an esterification reaction or a transesterification reaction and a condensation reaction. In a polymerization process for producing a polyester resin, for example, a polymerization catalyst such as titanium tetrabutoxide, dibutyl tin oxide, tin acetate, zinc acetate, tin sulfide, antimony trioxide and germanium dioxide can be used. Furthermore, the polymerization temperature is not particularly limited; however, the polymerization temperature favorably falls within the range of 180° C. or more but 290° C. or less.

Furthermore, the binder resin may be a hybrid resin prepared by chemically binding a polyester unit and a vinyl copolymer unit.

The mixing ratio of the polyester unit and the vinyl copolymer unit is favorably 50:50 to 100:0 by mass ratio. If the mixing ratio of the polyester unit is less than 50 mass %, the number of functional groups such as an ester group decreases. As a result, it is difficult to control the balance between the dielectric loss factor and the true specific gravity.

As a vinyl monomer for producing a vinyl copolymer unit to be used in the binder resin of the present invention, the following styrene monomer and acrylic acid monomer are mentioned.

Examples of the styrene monomer as a monomer for producing a vinyl copolymer unit include styrene and o-methylstyrene. Examples of the acrylic acid monomer as a monomer for producing a vinyl copolymer unit include acrylic acid, methyl acrylate and n-butyl acrylate.

The vinyl copolymer unit may be a resin produced by using a polymerization initiator. As the polymerization initiator, a known initiator as mentioned below is used. Examples of the polymerization initiator include 2,2'-azobisisobutyronitrile, 2,2'-azobis(4-methoxy-2,4-dimethylvaleronitrile) and 2,2'-azobis(2,4-dimethylvaleronitrile).

These initiators are each favorably used in an amount of 0.05 parts by mass or more but 10 parts by mass or less based on a monomer (100 parts by mass), in view of efficiency.

The hybrid resin is a resin in which a polyester unit and a vinyl copolymer unit are chemically bound directly or indirectly.

Thus, polymerization is performed by using a compound capable of reacting with both monomers of the polyester unit and the vinyl copolymer unit (hereinafter referred to as a "double reactive compound"). Examples of such a double reactive compound include compounds such as fumaric acid, acrylic acid, methacrylic acid, citraconic acid, maleic acid and dimethyl fumarate contained in a monomer of a condensation polymerized resin as mentioned above and a monomer of an addition polymerized resin as mentioned above. Of these, fumaric acid, acrylic acid and methacrylic acid are favorably used.

The use amount of double reactive compound is 0.1 mass % or more but 20 mass % or less and favorably 0.2 mass % or more but 10 mass % or less based on the total raw-material monomers.

In the present invention, to impart mold-releasing characteristics to a magnetic toner, if necessary, a mold-releasing agent (wax) can be used. As the wax, in view of dispersibility in a magnetic toner particle and sufficient mold-releasing characteristics, a low molecular-weight polyethylene, a low molecular-weight polypropylene, microcrystalline wax, a hydrocarbon wax such as paraffin wax are favorably used. If necessary, a single or two types or more waxes may be used in combination in a small amount. Examples of the wax include the following ones:

an oxide of an aliphatic hydrocarbon wax such as a polyethylene oxide wax or a block copolymer thereof; a wax containing an aliphatic ester as a main component, such as carnauba wax, Sasol wax and montanic acid ester wax; wax having a whole or part of an fatty acid ester deoxidized, such as deoxidation carnauba wax. Further examples of the wax include the following ones: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; long-chain alkyl alcohols; polyhydric alcohols such as sorbitol; fatty acid amides such as linoleic amide, oleic amide and lauric amide; saturated fatty acid bisamides such as methylenebisstearic amide, ethylenebiscapric amide, ethylenebislauric amide and hexamethylenebisstearic amide; unsaturated fatty acid amides such as ethylenebisoleic amide, hexamethylenebisoleic amide, N,N'-dioleyladipic amide and N,N-dioleylsebacic amide; aromatic bisamides such as m-xylenebisstearic amide and N,N-distearylisophthalic amide; fatty acid metal salts such as calcium stearate, calcium laurate, zinc stearate and magnesium stearate (generally called as a metal soap); waxes obtained by grafting a vinyl monomer such as styrene or acrylic acid into an aliphatic hydrocarbon wax; a partially esterified substance of a fatty acid and a polyhydric alcohol, such as a monoglyceride of behenic acid; and methyl ester compounds having a hydroxyl group obtained by hydrogenation of a vegetable fat and oil.

Specific examples that can be used include the following ones: Biscol (registered trade mark) 330-P, 550-P, 660-P, TS-200 (manufactured by Sanyo Chemical Industries, Ltd.); Hi-wax 400P, 200P, 100P, 410P, 420P, 320P, 220P, 210P, 110P (manufactured by Mitsui Chemicals Inc.); Sasol H1, H2, C80, C105, C77 (Sasol wax); HNP-1, HNP-3, HNP-9, HNP-10, HNP-11, HNP-12 (NIPPON SEIRO CO. LTD), Unilin (registered trade mark) 350, 425, 550, 700, and Unisid (registered trade mark) 350, 425, 550, 700 (Toyo Petrolite); and Japanese wax, bees wax, rice wax, Candelilla wax, carnauba wax (CERARICA NODA Co., Ltd.).

The timing of adding the wax may be during melt/kneading time in producing a magnetic toner or during a production time for a binder resin, and is appropriately selected from the timings of addition according to conventional methods.

The wax is favorably added in an amount of 1 part by mass or more but 20 parts by mass or less based on a binder resin (100 parts by mass).

Examples of the magnetic iron oxide particle used in the present invention include magnetic iron oxide particles such as magnetite, maghemite and ferrite and magnetic iron oxide particles including other metal oxides. Examples of the magnetic iron oxide particles conventionally known include, triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$) and iron powder (Fe). Particularly favorable magnetic iron oxide particle is a triiron tetroxide or $\gamma$-iron sesquioxide fine powder. The aforementioned magnetic iron oxide particles can be used alone or in combination of two types or more. A magnetic iron oxide fine particle is favorably added in an amount of 30 parts by mass or more but 90 parts by mass or less to the binder resin (100 parts by mass) and more favorably 30 parts by mass or more but 75 parts by mass or less.

The shape of the magnetic iron oxide particle to be used in the magnetic toner of the present invention is more favorably an octahedron whose dispersibility in a magnetic toner is more satisfactory. If an octahedron magnetic iron oxide particle is used, balance between a dielectric loss factor and a true specific gravity tends to be easily controlled.

In the magnetic toner of the present invention, a charge-controlling agent can be used in order to stabilize electrification characteristics. The content of the charge-controlling agent varies depending upon the type or physical properties of other constitutional materials for a toner particle; however, generally, the content is favorably 0.1 part by mass or more but 10 parts by mass or less based on a binder resin (100 parts by mass) in a toner particle and more favorably 0.1 part by mass or more but 5 parts by mass or less. As such a charge-controlling agent, various charge-controlling agents can be used singly or in combination of two or more types depending upon the type and use of the magnetic toner.

Example of a charge-controlling agent which controls a magnetic toner to be negatively charged include the following ones: organic metal complexes (a monoazometal complex; an acetyl acetone metal complex); and metal complex and metal salts of an aromatic hydroxycarboxylic acid or an aromatic dicarboxylic acid. Other than those, examples of a charge-controlling agent which controls a magnetic toner to be negatively charged include an aromatic mono and polycarboxylic acids, metal salts and anhydride thereof; and an ester and a phenol derivative such as bisphenol. Of them, a metal complex or metal salt of a monoazo compound is particularly favorably used since a stable electrification characteristic can be obtained. Furthermore, a charge control resin can be used, and can be used in combination with a charge-controlling agent as mentioned above.

In the magnetic toner of the present invention, a flowability improver is favorably used, which is an inorganic fine powder capable of improving flowability of magnetic toner particles by attaching onto the surface of the magnetic toner base particles, having a smaller number average particle diameter of a primary particle and a BET specific surface area of 50 $m^2/g$ or more but 300 $m^2/g$ or less. Any flowability improver can be used as long as the flowability improver increases flowability by externally adding it to magnetic toner base particles. Examples of the flowability improver include the following ones: a fluorine resin powder such as a vinylidene fluoride fine powder and polytetrafluoroethylene fine powder; a silica fine powder prepared by a wet-process and a dry-process; and silica surface-treated with a silane coupling agent, a titanium coupling agent or a silicone oil.

The inorganic fine powder may be used in an amount of 0.01 part by mass or more but 8 parts by mass or less based on the magnetic toner base particle (100 parts by mass) and favorably 0.1 part by mass or more but 4 parts by mass or less.

To the magnetic toner of the present invention, if necessary, other external additives may be added. Examples of the external additives include an electrification auxiliary agent, a conductivity-imparting agent, a flowability-imparting agent, an anti-caking agent, a mold-releasing agent for use in depositing on a heating roller, a lubricant, and a resin microparticle and an inorganic microparticle serving as a polishing agent.

Examples of the lubricant include a polyfluoroethylene powder, a zinc stearate powder and polyvinylidene fluoride powder. Of them, polyvinylidene fluoride powder is favorable. Examples of the polishing agent include a cerium oxide powder, a silicon carbide powder and a strontium titanate powder. These external additives are sufficiently mixed by use of a Henschel mixer, etc. to obtain the magnetic toner of the present invention.

The magnetic toner of the present invention is prepared by sufficiently mixing a binder resin, a colorant and other additives by a mixer such as a Henschel mixer or a ball mill and then subjecting the mixture to melt/kneading performed by use of a heat kneader such as a heat roll, a kneader and an extruder, cooling the mixture to solidify, followed by pulverizing and classifying to obtain a magnetic toner particle and further adding a silica microparticle to the magnetic toner particle and sufficiently mixing the mixture by a mixer such as a Henschel mixer. In this manner, the magnetic toner of the present invention can be obtained.

Examples of the mixer include the following ones: Henschel mixer (manufactured by Mitsui Kozan); Super mixer (manufactured by KAWATA MFG Co., Ltd.); Ribocorn (manufactured by OKAWARA CORPORATION); Nautor Mixer, Turbulizer and Cycromix (manufactured by Hosokawa Micron Group); and Spiral pin mixer (manufactured by Pacific Machinery & Engineering Co., Ltd); and Loedige Mixer (manufactured by MATSUBO Corporation). Examples of the kneader include the following ones: KRC kneader (manufactured by KURIMOTO LTD.); Buss co-kneader (manufactured by Buss); TEM type extruder (manufactured by TOSHIBA MACHINE CO., LTD.); TEX two-shaft kneader (manufactured by The Japan Steel Works, LTD.); PCM kneader (manufactured by IKEGAI Metal); a triple roll mill, a mixing roll mill and a kneader (manufactured by INOUE MANUFACTURING CO., LTD.); Kneadex (manufactured by Mitsui Kozan); MS system pressure kneader and Kneader-Ruder (manufactured by Moriyama Manufacturing Co., Ltd.); and BANBURY mixer (manufactured by KOBE STEEL LTD.). Examples of the pulverizer include the following ones: Counter jet mill, Micron jet and Inomizer (manufactured by Hosokawa Micron Group); IDS type mill and PJM jet pulverizer (manufactured by NIPPON PNEUMATIC MFG. CO., LTD.); Cross jet mill (manufactured by KURIMOTO LTD.); ULMAX (manufactured by NISSO ENGINEERING CO., LTD.); SK Jet O mill (manufactured by SEISHIN ENTERPRISE Co., Ltd.); Cryptron (manufactured by Kawasaki Heavy Industries, Ltd.); Turbo mill (manufactured by Turbo Kogyo); and Super rotor (manufactured by Nisshin Engineering Inc.). Examples of the classifier include the following ones: Classiel, Micron Classifier and Spedic Classifier (manufactured by SEISHIN ENTERPRISE Co., Ltd.); Turbo classifier (manufactured by Nisshin Engineering Inc.); Micron separator, Turbo plex (ATP) and TSP separator (manufactured by Hosokawa Micron Group); Elbow jet (manufactured by Nittetsu Mining Co., Ltd.), Dispersion separator (manufactured by NIPPON PNEUMATIC MFG. CO., LTD.); and YM microcut (manufactured by Yasukawa Shoji). Examples of the sieving apparatus for sieving and separating coarse particles include the following ones: Ultrasonic (manufactured by Koei Sangyo Co., Ltd.); Resona Sieve and Gyro Shifter (manufactured by TOKUJU Co., LTD); Vibra Sonic System (manufactured by DALTON Co., Ltd.); Soni Clean (manufactured by SINTOKOGIO, LTD.); Turbo Screener (manufactured by Turbo Kogyo); a Micro Shifter (manufactured by Makino Sangyo); and a circular vibration sieve.

The magnetic toner of the present invention exerts a particularly satisfactory effect in an image forming apparatus having a magnetic force applied on a sleeve surface of 55.00 kA/m or more but 96.00 kA/m or less.

Next, methods for measuring physical properties according to the present invention will be described below.

(1) DSC Analysis of Binder Resin

In the present invention, the endothermic peak of a DSC curve of a binder resin is measured by the following method. The temperature of endothermic peak of a binder resin is measured by use of a differential scanning calory analyzer "Q1000" (manufactured by TA Instruments) in accordance with ASTM D3418-82.

The temperature measured by a detecting section of the analyzer is corrected based on the melting points of indium and zinc and calory is corrected based on heat of fusion of indium.

To describe more specifically, a binder resin (about 5 mg) is weighed and placed in a pan made of aluminum. A vacant aluminum pan is used as a reference. Measurement is performed in the temperature range of 30 to 200° C. at a temperature raising rate of 10° C./min. Note that, in the measurement, temperature is increased once up to 200° C. and subsequently decreased to 30° C. and thereafter increased again. In this temperature raising process, a specific heat changes. The intersection between the DSC curve and the line drawn through the middle point of the base lines which are respectively drawn through the points before and after the point of specific heat change, is defined as a glass transition temperature Tg of the binder resin.

The endothermic peak obtained in the second temperature raising process within the temperature range of 30° C. or more and 200° C. or less is defined as the endothermic peak of the binder resin.

(2) Measurement of a Softening Point of a Binder Resin

The softening point used in the present invention is obtained by the following method.

The softening point of a binder resin is measured by use of a constant-load extruding type Capillary Rheometer "rheological property evaluation apparatus, Flow Tester CFT-500D" (manufactured by Shimadzu Corporation) in accordance with the manual attached to the apparatus. In the apparatus, the temperature of the measurement sample loaded in a cylinder is increased while applying a predetermined load by a piston onto a measurement sample to melt the sample. The measurement sample melted is extruded from a die at the bottom of the cylinder. The amount of descent of the piston at this time and temperature are plotted to obtain a rheogram showing the relationship of the amount of descent and the temperature.

In the present invention, "melting temperature in the ½ method" described in the manual attached to "rheological property evaluation apparatus, Flow Tester CFT-500D" is defined as a softening point. Note that the "melting temperature in the ½ method" is calculated as follows. First, the difference between Smax, which is the amount of descent of a piston at the time outflow is completed, and Smin, which is the amount of descent of a piston at the time outflow is initiated, is divided in half (this is expressed by X. X=(Smax−Smin)/2). Then, in the rheogram, the temperature at the time when the amount of descent of a piston is equal to a sum of X and Smin is obtained. The temperature of the rheogram is the melting temperature obtained by the ½ method.

A measurement sample is prepared by compress-molding a binder resin (about 1.0 g) under an environment of 25° C. by using a tablet forming compressor (for example, NT-100H, manufactured by NPa SYSTEM CO., LTD.) at a pressure of about 10 MPa for about 60 seconds into a disk having a diameter of about 8 mm.

The measurement conditions for CFT-500D are as follows.

Test mode: Temperature raising method
Initiation temperature: 30° C.
Achieving temperature: 200° C.
Measurement interval: 1.0° C.
Temperature increase rate: 4.0° C./min
Sectional area of piston: 1.000 $cm^2$
Test load (piston load): 10.0 kgf (0.9807 MPa)
Preheating time: 300 seconds
Hole diameter of die: 1.0 mm
Length of die: 1.0 mm (3) Determination of Weight Average Particle Size (D4) of Magnetic Toner The weight average particle size (D4) of a magnetic toner is determined by a precision grain size distribution measurement apparatus called "Coulter counter Multisizer 3" (registered trade mark, manufactured by Beckman Coulter) equipped with a 100 μm-aperture tube based on pore electrical resistance method and attached special software "Beckman Coulter Multisizer 3 Version 3.51" (manufactured by Beckman Coulter) for setting measurement conditions and measurement data analysis, with an effective number of measurement channels of 25,000. The measurement data is analyzed and computationally obtained.

The aqueous electrolyte to be used in measurement is prepared by dissolving a special grade sodium chloride in ion exchange water so as to obtain a concentration of about 1 mass %. For example, "ISOTON II" (manufactured by Beckman Coulter) can be used.

Note that before measurement and analysis are performed, the special software is set up as follows.

In the "setting screen for changing standard operation method (SOM)" of the special software, the total count number of a control mode is set at 50000 particles and measurement times is set at 1. As the Kd value, the value obtained by using "a standard particle 10.0 μm" (manufactured by Beckman Coulter) is set. A threshold/noise level measurement button is pressed to automatically set a threshold/noise level. Furthermore, current is set at 1600 μA and gain is set at 2. An electrolyte is set at ISOTON II and flush of the aperture tube after measurement is checked.

In the "setting screen for converting pulse to particle diameter" of the special software, the interval between bins is changed to logarithmic particle diameter; the particle diameter bin is set at 256 particle diameter bin; and the particle diameter range is set at 2 μm to 60 μm.

Specific measurement method is as follows.

(1) To a 250-ml round-bottom beaker made of glass for exclusive use for Multisizer 3, an aqueous electrolyte solution (about 200 ml) as mentioned above is supplied. The beaker is placed in a sample stand. The electrolyte solution was stirred by rotating a stirrer rod counterclockwise at 24 rotations/second. Subsequently, using "flush aperture" function of the analysis soft, contaminants and air bubbles within an aperture tube are previously removed.

(2) To a 100 ml flat-bottom beaker made of glass, the aqueous electrolyte solution (about 30 ml) is supplied. To the aqueous electrolyte solution, about 0.3 ml of a dilution solution, which is prepared by diluting "Contaminon N" (an aqueous 10 mass % solution of a neutral detergent for cleaning precision measuring equipment containing a nonionic surfactant, an anion surfactant, an organic builder, pH7; manufactured by Wako Pure Chemical Industries Ltd.) serving as a dispersant, with ion exchange water three fold by mass, is added.

(3) In the water vessel of "Ultrasonic Dispersion System Tetora 150" (manufactured by Nikkaki Bios Co., Ltd) housing two oscillators having an oscillation frequency of 50 kHz with the phases shifted by 180° and having an electric output of 120 W, a predetermined amount of ion exchange water is supplied, and Contaminon N (about 2 ml) as mentioned above is added to the ion exchange water in the water vessel.

(4) The beaker (2) is set at a beaker fixing hole of the ultrasonic dispersion system and the ultrasonic dispersion system is driven. Subsequently, the level of the beaker is controlled such that the resonant condition of liquid surface of the aqueous electrolyte solution in the beaker reaches a maximum.

(5) While applying ultrasonic wave to the aqueous electrolyte solution in the beaker (4), a magnetic toner (about 10 mg) is added to the aqueous electrolyte solution little by little and dispersed. Then, the dispersion treatment with ultrasonic wave is continued for further 60 seconds. Note that, in the dispersion treatment with ultrasonic wave, the temperature of water in the water vessel is appropriately controlled so as to fall within the range of 10° C. or more and 40° C. or less.

(6) To the round-bottom beaker (1) set at the sample stand, the above aqueous electrolyte solution (5) having a magnetic toner dispersed therein is added dropwise by a pipette. The measurement concentration is controlled so as to be about 5%. Then, measurement is performed until a number of particles reaches 50000.

(7) Measurement data is analyzed by means of the special software attached to the apparatus to computationally obtain a weight average particle size (D4). Note that "average diameter" of an analysis/volume statistical value (arithmetic average) screen when graph/vol. % is set in the special software is the weight average particle size (D4).

EXAMPLES

In the foregoing, the basic constitution and characteristics of the present invention have been described. Now, the present invention will be described in detail based on Examples, below. However, the present invention is not limited to Examples.

<Production Example of Binder Resin A-1>

| | |
|---|---|
| Terephthalic acid | 70 parts by mol |
| Fumaric acid | 30 parts by mol |
| 1,6-hexane diol | 80 parts by mol |
| Neopentyl glycol | 20 parts by mol |

The above monomers and dibutyl tin oxide were added in an amount of 0.03 parts by mass based on all acid components and allowed to react under nitrogen airflow at 220° C. while stirring so as to reach a desired softening point to obtain binder resin A-1. The physical properties of the resin are shown in Table 2.

<Production Examples of Binder Resin A-2 to A-7>

Binder resin A-2 to A-7 were obtained in the same manner as in obtaining binder resin A-1 except that monomer constitution was changed to those shown in Table 1. The physical properties of the resin are shown in Table 2.

TABLE 1

| Resin No. | Acid monomer | Parts by mol | | Parts by mol | Alcohol monomer | Parts by mol | | Parts by mol |
|---|---|---|---|---|---|---|---|---|
| A-1 | TPA | 70 | FA | 30 | 1,6-hexane diol | 80 | NPG | 20 |
| A-2 | TPA | 70 | FA | 30 | 1,6-hexane diol | 90 | BPA-EO | 10 |
| A-3 | TPA | 100 | — | — | EG | 75 | BPA-EO | 25 |
| A-4 | TPA | 90 | TMA | 10 | EG | 65 | NPG | 35 |
| A-5 | TPA | 94 | TMA | 6 | BPA-PO | 100 | — | — |
| A-6 | TPA | 80 | FA | 20 | BPA-EO | 100 | — | — |
| A-7 | TPA | 100 | — | — | 1,6-hexane diol | 100 | — | — |

Note that brevity codes of Table 1 represents the following substances.

TPA: Terephthalic acid

FA: Fumaric acid

TMA: Trimellitic anhydride

EG: Ethylene glycol

BPA-EO: Ethylene oxide adduct of bisphenol A (average addition mol number: 2.2 mol)

BPA-PO: Propylene oxide adduct of bisphenol A (Average addition mol number: 2.2 mol)

NPG: Neopentyl glycol

<Production Example of Binder Resin A-8>

| | |
|---|---|
| Terephthalic acid | 24 parts by mol |
| Dodecenyl succinic acid | 16 parts by mol |
| Trimellitic acid | 7 parts by mol |
| Bisphenol A-PO adduct (propylene oxide 2.5 mol adduct) | 31 parts by mol |
| Bisphenol A-EO) adduct (ethylene oxide 2.5 mol adduct) | 22 parts by mol |

The above acid components and alcohol components serving as monomers for producing a polyester unit and tin 2-ethylhexanoate serving as a catalyst were supplied to a 4-neck flask. A pressure reducing apparatus, a water removing apparatus, a nitrogen gas introducing apparatus, a temperature measurement apparatus and a stirring apparatus were provided. To this mixture, while stirring at 130° C. under a nitrogen atmosphere, a mixture, which contains monomers for producing a styrene-acryl resin unit shown below in an amount of 25 parts by mass based on a monomer component (100 parts by mass) for producing the above polyester unit, together with a polymerization initiator (benzoyl peroxide), was added dropwise through a dropping funnel for 4 hours.

| | |
|---|---|
| Styrene | 82 mass % |
| 2-ethylhexyl acrylate | 16 mass % |
| Acrylic acid | 2 mass % |

The above substances were maintained at a temperature of 130° C. and aged for 3 hours. The temperature of the mixture was raised to 230° C. to carry out a reaction. After completion of the reaction, the resultant product was taken out from the container and pulverized to obtain binder resin A-8 containing a polyester resin component, a vinyl polymer component and a hybrid resin component in which a polyester unit and a styrene-acryl resin unit were chemically bound. The physical properties of the resin are shown in Table 2.

TABLE 2

| Resin No. | Peak temperature (° C.) | Tg (° C.) | Softening point (° C.) |
|---|---|---|---|
| A-1 | 57 | 52 | 90 |
| A-2 | 59 | 54 | 95 |
| A-3 | 77 | 70 | 107 |
| A-4 | 64 | 60 | 101 |
| A-5 | — | 56 | 95 |
| A-6 | — | 68 | 130 |
| A-7 | 109 | — | 113 |
| A-8 | — | 58 | 97 |

<Production Example of Magnetic Iron Oxide Particle B-1>

To an aqueous solution (50 L) containing $Fe^{2+}$ (2.0 mol/L), an aqueous solution (10 L) containing $Si^{4+}$ (0.23 mol/L) in the form of a water soluble silicic acid salt was added. The resultant mixture was mixed with an aqueous solution (42 L) containing NaOH (5.0 mol/L) while stirring to obtain ferrous hydroxide slurry. The pH of the ferrous hydroxide slurry was controlled to be 12 and aerated at a rate of 30 L/min and at a temperature 90° C. to carry out an oxidation reaction until a core particle grew up to 50% of a desired size. Subsequently, aeration was performed at a rate of 20 L/min until a core particle grew up to 75% of a desired size. Subsequently aeration was performed at a rate of 10 L/min until a core particle grew up to 90% of a desired size. Next, aeration was performed at a rate of 5 L/min to complete the oxidation reaction. In this manner, core particle slurry was obtained.

To the resultant core particle slurry of a magnetic iron oxide particle, an aqueous solution of silicic acid soda (which contains 13.4% by mass of Si) (120 g) and an aqueous aluminum sulfate solution (Al quality 4.2%) (380 g) were simultaneously added. The pH of the mixture was adjusted to 5 or more and 9 or less to obtain slurry of a magnetic iron oxide particle having a coating layer containing silicon and aluminum formed on the surface. The resultant slurry containing a magnetic iron oxide particle was filtrated, dried and pulverized in accordance with customary methods to obtain octahedron magnetic iron oxide particle B-1. Note that magnetic iron oxide particle B-1 had a saturation magnetization of 67 $Am^2/kg$ at an application of a magnetic field of 79.58 kA/m (1 k oersted).

<Production Example of Magnetic Iron Oxide Particle B-2>

An aqueous ferrous sulfate solution (65 L) containing $Fe^{2+}$ (1.55 mol/L) and a 2.37 mol/L aqueous sodium hydroxide solution (88 L) were mixed and stirred.

The concentration of the residual sodium hydroxide in a mixed aqueous solution was controlled to be 2.1 g/L. Thereafter, the mixed aqueous solution was aerated at a rate of 30

L/min while maintaining the temperature at 80° C. and pH at 6 to 8 to terminate a first oxidation reaction at a time.

Subsequently, to an aqueous ferrous sulfate solution containing $Fe^{2+}$ (1.27 mol/L), zinc sulfate was added so as to obtain $Zn^{2+}$ (0.5 mol/L). In this way, an aqueous solution (2.25 L) was separately prepared and added to the aforementioned reaction slurry. The resultant slurry was aerated at a rate of 15 L/min while maintaining the pH at 6 to 8 to terminate a second oxidation reaction.

Subsequently, to an aqueous ferrous sulfate solution containing $Fe^{2+}$ (1.01 mol/L), sodium silicate (No. 3) was added so as to obtain $Si^{4+}$ (0.44 mol/L). In this way, an aqueous solution (2.3 L) was separately prepared and added to the aforementioned reaction slurry. The resultant slurry was aerated at a rate of 15 L/min while maintaining the pH at 6 to 8 to terminate a third oxidation reaction. The resultant particle was washed, filtrated, dried and pulverized in accordance with customary processes to obtain spherical magnetic iron oxide particle B-2. Note that magnetic iron oxide particle B-2 had a saturation magnetization of 63 $Am^2/kg$ at an application of a magnetic field of 79.58 kA/m (1 k oersted).

Example 1

| | |
|---|---|
| Binder resin A-1 | 100 parts by mass |
| Magnetic iron oxide particle B-1 | 90 parts by mass |
| Polyethylene wax (PW2000, melting point: 120° C.) | 4 parts by mass |
| Charge-controlling agent (T-77: manufactured by Hodogaya Chemical Co., LTD) | 2 parts by mass |

The above materials were pre-mixed by a Henschel mixer and thereafter melted and kneaded by a two-shaft kneading extruder.

The kneaded product thus obtained was cooled, roughly pulverized by a hammer mill and then pulverized by a jet mill. The resultant fine powder pulverized was classified by a hyperfractionation classifier using the Coanda effect to obtain a magnetic toner base particle negatively and frictionally charged and having a weight average particle size (D4) of 6.8 μm. A silica fine particle (bulk BET specific surface area: 300 $m^2/g$, treated with hexamethyl disilazane) in an amount of 0.8 parts by mass based on the magnetic toner base particle (100 parts by mass) and strontium titanate (number average particle diameter: 1.2 μm) in an amount of 3.0 parts by mass were externally mixed to the magnetic toner base particle and sieved by a mesh having an opening of 150 μm to obtain magnetic toner C-1 negatively charged by friction. Physical properties of magnetic toner C-1 are shown in Table 4.

Evaluation was performed by use of a commercially available copier (IR-5075N manufactured by Canon Inc). As the paper to be used for evaluation, CS-680 (manufactured by Canon Inc.) of 68 $g/m^2$ was used. In this apparatus, the magnetic force upon the sleeve surface of the copier was 75.78 kA/m. A duration test was performed by printing images on 20,000 paper sheets by using a test chart having a printing ratio of 5% and magnetic toner C-1, separately under a high-temperature and high-humidity environment (30° C., 80% RH) and under a normal-temperature and low-humidity environment (23° C., 5% RH). Thereafter, image density, sleeve contamination and fogging were evaluated by the methods describe below. The results are shown in Table 5.

(Evaluation of Image Density)

Image density was determined by measuring reflection density of a circle image of 5 mm in diameter by use of Macbeth densitometer (manufactured by Macbeth) using an SPI filter. In each test environment, a difference in reflection density between the initial printing (100th sheet) and printing after the duration test (20000 sheets) was obtained and image density was evaluated based on the following criteria.

A (very excellent): less than 0.05

B (satisfactory): 0.05 or more and less than 0.10

C (neither good nor bad): 0.10 or more and less than 0.15

D (slightly bad): 0.15 or more and less than 0.20

E (bad): 0.20 or more (Evaluation of Sleeve Contamination)

After the duration test (20000 sheets of printing), the magnetic toner on the sleeve was removed and sleeve contamination was visually evaluated.

Contamination level of a sleeve was evaluated based on the following criteria.

A (very excellent): No problem is found on a sleeve and on an image.

B (satisfactory): slight contamination is partly found on a sleeve; however, no problem is found on an image.

C (neither good nor bad): slight contamination is partly found on a sleeve; and the density of an image is partly thin.

D (slightly bad): the entire sleeve is contaminated and the density of an image is partly thin.

E (bad): The entire sleeve is contaminated and the density of an image is entirely thin.

(Evaluation of Fogging)

Fogging was measured by a reflectometer (TC-6DS manufactured by Tokyo Denshoku Co., Ltd.). Provided that the worst value of reflection density of a white portion after an image was formed was represented by Ds, an average reflection density of a transfer material before an image was formed was represented by Dr, the value of Dr−Ds was regarded as a fogging amount. Based on the fogging amount, fogging was evaluated. Therefore, a lower numerical value of the fogging amount means that fogging is excellently suppressed. The fogging was evaluated under each of the test environments by performing a duration test (20,000 sheets), allowing the sheets alone for a week, the white solid image of the second sheet was evaluated in accordance with the following criteria.

A (very excellent): fogging value is less than 1.0

B (excellent): fogging value is 1.0 or more and less than 2.0

C (neither good nor bad): fogging value is 2.0 or more and less than 3.0

D (slightly bad): fogging value is 3.0 or more and less than 4.0

E (bad): fogging value is 4.0 or more and less than 5.0.

Examples 2 to 12

Magnetic toner C-2 to magnetic toner C-12 were obtained in the same manner as in the production example for magnetic toner C-1 except that the binder resin and the magnetic iron oxide particle were changed as shown in Table 3. Physical properties of the resultant magnetic toners are shown in Table 4. The same tests as in Example 1 were performed. The results are shown in Table 5.

Comparative Examples 1 to 9

Magnetic toner C-13 to magnetic toner C-21 were obtained in the same manner as in the production example for magnetic toner C-1 except that the binder resin and the magnetic iron oxide particle were changed as shown in Table 3. Physical properties of the resultant magnetic toners are shown in Table 4. The same tests as in Example 1 were performed. The results are shown in Table 5.

TABLE 3

| Toner No. | Binder resin No. | parts by mass | No. | parts by mass | No. | parts by mass | Magnetic iron oxide particle No. | parts by mass |
|---|---|---|---|---|---|---|---|---|
| C-1 | A-1 | 100 | — | — | — | — | B-1 | 45 |
| C-2 | A-1 | 100 | — | — | — | — | B-1 | 75 |
| C-3 | A-2 | 100 | — | — | — | — | B-1 | 30 |
| C-4 | A-1 | 80 | A-6 | 20 | — | — | B-1 | 75 |
| C-5 | A-3 | 100 | — | — | — | — | B-1 | 75 |
| C-6 | A-1 | 50 | A-6 | 50 | — | — | B-1 | 45 |
| C-7 | A-1 | 50 | A-6 | 40 | A-7 | 10 | B-1 | 45 |
| C-8 | A-4 | 50 | A-6 | 30 | A-7 | 20 | B-1 | 75 |
| C-9 | A-5 | 80 | A-7 | 20 | — | — | B-2 | 90 |
| C-10 | A-4 | 100 | — | — | — | — | B-2 | 30 |
| C-11 | A-5 | 50 | A-7 | 50 | — | — | B-2 | 90 |
| C-12 | A-5 | 70 | A-8 | 30 | — | — | B-2 | 30 |
| C-13 | A-4 | 100 | — | — | — | — | B-2 | 90 |
| C-14 | A-4 | 100 | — | — | — | — | B-2 | 10 |
| C-15 | A-5 | 100 | — | — | — | — | B-2 | 110 |
| C-16 | A-8 | 100 | — | — | — | — | B-2 | 90 |
| C-17 | A-8 | 100 | — | — | — | — | B-2 | 75 |
| C-18 | A-1 | 100 | — | — | — | — | B-2 | 110 |
| C-19 | A-5 | 100 | — | — | — | — | B-2 | 100 |
| C-20 | A-1 | 80 | A-6 | 20 | — | — | B-2 | 10 |
| C-21 | A-8 | 100 | — | — | — | — | B-2 | 30 |

TABLE 4

| Toner No. | Dielectric loss factor (100 kHz) | True specific gravity | Dielectric loss factor (3 kHz) | aliphatic alcohol (mol %) | Saturated magnetization ($Am^2/kg$) |
|---|---|---|---|---|---|
| C-1 | 0.67 | 1.64 | 0.27 | 100 | 20 |
| C-2 | 0.80 | 1.80 | 0.40 | 100 | 28 |
| C-3 | 0.60 | 1.60 | 0.25 | 90 | 15 |
| C-4 | 0.77 | 1.78 | 0.39 | 80 | 28 |
| C-5 | 0.73 | 1.78 | 0.38 | 75 | 28 |
| C-6 | 0.62 | 1.64 | 0.22 | 50 | 20 |
| C-7 | 0.70 | 1.64 | 0.50 | 60 | 20 |
| C-8 | 0.80 | 1.78 | 0.51 | 70 | 28 |
| C-9 | 0.80 | 1.85 | 0.54 | 20 | 29 |
| C-10 | 0.60 | 1.50 | 0.19 | 100 | 14 |
| C-11 | 0.90 | 1.85 | 0.60 | 50 | 29 |
| C-12 | 0.52 | 1.50 | 0.19 | 0 | 14 |
| C-13 | 0.88 | 1.93 | 0.46 | 100 | 29 |
| C-14 | 0.54 | 1.45 | 0.14 | 100 | 5 |
| C-15 | 0.51 | 1.95 | 0.31 | 0 | 32 |
| C-16 | 0.40 | 1.83 | 0.25 | 0 | 29 |
| C-17 | 0.30 | 1.73 | 0.17 | 0 | 26 |
| C-18 | 0.93 | 2.05 | 0.50 | 100 | 32 |
| C-19 | 0.47 | 1.87 | 0.25 | 0 | 31 |
| C-20 | 0.48 | 1.41 | 0.11 | 80 | 5 |
| C-21 | 0.20 | 1.48 | 0.07 | 0 | 14 |

TABLE 5

| Example No. | Toner No. | High-temperature and high-humidity environment: Sleeve contamination | Reflection density | Fogging after leaving alone | Normal-temperature and low-humidity environment: Sleeve contamination | Reflection density | Fogging after leaving alone |
|---|---|---|---|---|---|---|---|
| Example 1 | C-1 | A | A | A | A | A | A |
| Example 2 | C-2 | A | B | A | A | A | A |
| Example 3 | C-3 | B | A | A | A | A | A |
| Example 4 | C-4 | A | B | A | A | A | A |
| Example 5 | C-5 | A | B | B | A | A | A |
| Example 6 | C-6 | B | A | A | B | A | B |
| Example 7 | C-7 | A | B | B | A | A | B |
| Example 8 | C-8 | A | B | C | A | A | A |
| Example 9 | C-9 | A | C | C | A | B | A |
| Example 10 | C-10 | C | A | A | B | C | B |
| Example 11 | C-11 | A | D | C | A | B | A |
| Example 12 | C-12 | D | B | A | C | B | C |
| Comparative Example 1 | C-13 | A | D | B | A | C | B |
| Comparative Example 2 | C-14 | D | A | A | C | B | D |
| Comparative Example 3 | C-15 | B | C | C | C | D | D |
| Comparative Example 4 | C-16 | B | C | C | B | D | E |
| Comparative Example 5 | C-17 | B | C | C | B | D | E |
| Comparative Example 6 | C-18 | B | E | C | B | B | B |
| Comparative Example 7 | C-19 | B | C | E | A | E | E |
| Comparative Example 8 | C-20 | E | C | D | E | D | E |
| Comparative Example 9 | C-21 | E | C | D | E | E | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-015277, filed Jan. 27, 2011, which is hereby incorporated by reference herein in its entirety.

What is claimed is:

1. A magnetic toner comprising toner particles, each of which contains a binder resin and a magnetic iron oxide particle, wherein the binder resin has a polyester unit, the toner has i) a dielectric loss factor at 40° C. and 100 kHz of 0.50 pF/m or more but 0.90 pF/m or less, and ii) a true specific gravity of 1.50 g/cm$^3$ or more but 1.85 g/cm$^3$ or less.

2. The magnetic toner according to claim 1, wherein the toner has a dielectric loss factor at 40° C. and 3 kHz of 0.20 pF/m or more but 0.50 pF/m or less.

3. The magnetic toner according to claim 1, wherein an alcohol component of the polyester unit contains an aliphatic alcohol in an amount of 80 mol % or more.

* * * * *